United States Patent [19]

Stover et al.

[11] 4,271,009

[45] Jun. 2, 1981

[54] METHOD FOR REDUCING THE NITROGEN CONTENT OF SHALE OIL

[75] Inventors: Carole S. Stover, Van Nuys; Leslie E. Compton, Claremont; Eugene G. Youngerman, Downey, all of Calif.

[73] Assignee: Occidental Research Corporation, Irvine, Calif.

[21] Appl. No.: 52,637

[22] Filed: Jun. 27, 1979

[51] Int. Cl.[3] ..... C10G 17/04; C10G 17/07; G10G 21/18

[52] U.S. Cl. ..... 208/254 R; 208/280; 208/282; 208/290; 208/291

[58] Field of Search ..... 208/254 R, 280, 282, 208/290, 291, 11

[56] References Cited

U.S. PATENT DOCUMENTS

| | | | |
|---|---|---|---|
| 2,035,102 | 3/1936 | Stratford et al. | 208/234 |
| 2,263,176 | 11/1941 | Lazar et al. | 208/254 R |
| 2,309,324 | 1/1943 | McAllister et al. | 260/705 |
| 2,541,458 | 2/1951 | Berg | 260/705 |
| 2,662,843 | 12/1953 | Castner et al. | 208/254 R |
| 2,704,758 | 3/1955 | Wetzel | 546/181 |
| 3,523,071 | 8/1970 | Knapp et al. | 208/254 R |
| 3,974,063 | 8/1976 | Owen et al. | 208/254 R |
| 4,159,940 | 7/1979 | Smith | 208/254 H |

*Primary Examiner*—Delbert E. Gantz
*Assistant Examiner*—G. E. Schmitkons
*Attorney, Agent, or Firm*—Arnold Grant

[57] ABSTRACT

Methods are disclosed for reducing the nitrogen content of shale oil by selectively removing therefrom nitrogen-containing compounds. The nitrogen content of shale oil is reduced by a process comprising lowering the viscosity of the shale oil and then contacting the shale oil with a sufficient amount of a solvent which is selective toward the nitrogen-containing compounds present in the shale oil. The selective solvent is selected from the group consisting of organic acids, and substituted organic acids, particularly acetic, formic and trichloroacetic acids and mixtures thereof. The selective solvent system containing the nitrogen-containing compounds is separated from the reduced nitrogen content shale oil raffinate.

12 Claims, No Drawings

METHOD FOR REDUCING THE NITROGEN CONTENT OF SHALE OIL

BACKGROUND OF THE INVENTION

The method herein relates to reducing the total nitrogen content of shale oil by reducing the viscosity of the shale oil and then extracting nitrogen-containing compounds from the shale oil with an organic acid.

More particularly, this application relates to a method for reducing the nitrogen content of shale oil produced in either an above-ground or in an in situ oil shale retort.

The term "oil shale" as used in the industry is, in fact, a misnomer; it is neither shale nor does it contain oil. It is a sedimentary formation comprising marlstone deposits with layers containing an organic polymer called "kerogen" which, upon heating, decomposes to produce liquid and gaseous products. The formation containing kerogen is called "oil shale" herein and the liquid product produced upon decomposition of kerogen is called "shale oil".

Kerogen is considered to have been formed by the deposition of plant and animal remains in marine and nonmarine environments. Its formation is unique in nature. Alteration of this deposited material during subsequent geological periods produced a wide variety of organic materials. Source material and conditions of deposition were major factors influencing the type of final product formed.

Kerogen samples, found in various parts of the world, have nearly the same elemental composition. However, kerogen can consist of many different compounds having differing chemical structures. Some compounds found in kerogen have the structures of proteins while some have structures of terpenoids, and others have structures of asphalts and bitumens.

Shale oils produced from oil shale are generally high molecular weight, viscous organic liquids, of predominantly hydrocarbonaceous oxygen, nitrogen and sulfur or containing organic compounds. The shale oils are of varying linear, branched cyclic aromatic hydrocarbon and substituted hydrocarbon content with high pour points, moderate sulfur content and relatively high nitrogen content. As the composition of shale oil depends upon the composition of the kerogen within the oil shale formation, the composition of the shale oil can vary from one geographic location to another. The shale oil produced from an oil shale formation can vary also between strata within the oil shale formation. The nitrogen content of shale oil can also vary dependent upon the geographical location of the oil shale deposit from which the shale oil is produced. Such a variance in nitrogen content in different geographical locations can be attributed to differences in the environment during the time of the deposition of the organisms which, upon lithification, became oil shale. Such a variance can also be attributed to the different types of organisms in the separate geographical locations which were deposited to form the organic substance in the oil shale and any organisms within the formed deposit layer which acted upon such deposited material to provide the kerogen within the oil shale formation.

The nitrogen content in shale oil is attributable to basic nitrogen-containing compounds and nonbasic nitrogen-containing compounds. The relative percentages of the basic and non-basic nitrogen compounds comprising the total nitrogen content of a shale oil can also vary depending upon the particular shale oil.

The nitrogen content of shale oil is generally up to about two percent by weight. The average nitrogen content of shale oil recovered by in situ retorting of oil shale from the Piceance Creek Basin of Western Colorado is on the order of about 1.4 percent by weight.

The presence of nitrogen in shale oil presents many problems in that the nitrogen can interfere with the transportation and use of the shale oil. Deleterious effects brought about by the presence of nitrogen in shale oil are decreased catalyst life in dehydrogenation, reforming, hydrocracking and catalytic cracking reactions, decreased chemical stability of products, and decreased color stability of products. Another problem with the presence of nitrogen in shale oil is that it is undesirable to transport nitrogen-containing shale oil through pipelines which are also used for transporting petroleum products because of possible pollution of such products with residual nitrogen-containing shale oil in the pipeline. Generally such petroleum products contain a very low nitrogen content. The relatively high nitrogen content in the shale oil can pollute the pipelines making them undesirable and uneconomical for transporting such low nitrogen-containing petroleum products. In addition, high nitrogen content in shale oil can cause clogging of pipelines due to self-polymerization brought about by the reactivity of the nitrogen-containing compounds. Due to the basicity of the nitrogen-containing compounds in shale oil some corrosion can occur thus damaging a pipeline used to transport shale oil.

Product stability is a problem that is common to many products derived from shale oil with the major exception of the asphalt cut and those products that have undergone extensive hydrotreating. Such instability, including photosensitivity, is believed to be resultant, primarily from the presence of nitrogen-containing compounds.

It is, therefore, desirable to reduce the nitrogen content of shale oil to increase the utility, transportability, and stability of the shale oil and the products derived from such shale oil.

Due to the undesirable nature of nitrogen in organic fluid streams, such as fluid streams produced in the recovery and refining of petroleum, coal and oil shale, many processes have been developed to reduce the nitrogen content to an acceptable level. The level of acceptability for the nitrogen content is generally based upon the use of the particular stream.

In U.S. Pat. No. 3,719,587 to Karchmer et al a process is disclosed for removing basic nitrogen-containing compounds from coal naphtha. The basic nitrogen compounds are removed by washing the naphtha with water or with a dilute aqueous solution of a strong acid. The dilute acid solutions are disclosed as sulfuric acid, hydrochloric acid, phosphoric acid and acetic acid.

U.S. Pat. 2,848,375 to Gatsis discloses a process for removing basic nitrogen compounds from organic substances by washing with a weak acid in combination with a polyalcohol. The weak acid used is boric acid in combination with a polyhydroxy organic compound which has hydroxyl groups on adjacent carbons.

U.S. Pat. No. 2,741,578 to McKinnis teaches that mineral oils can be treated to recover the nitrogen bases by extracting the mineral oils with a selective solvent for the nitrogen bases. The selective solvents are organic hydroxy compounds. Organic hydroxy compounds which can be used are the compounds which have a pH greater than 6.5.

U.S. Pat. No. 2,035,583 to Bailey discloses a process for the separation and recovery of nitrogen bases from mineral oils. In the process, the mineral oil is extracted with a solvent for the nitrogen bases. Acceptable solvents are liquid sulfur dioxide, furfural, aniline, nitrobenzene and isobutyl alcohol. However, due to the solubility of desirable mineral oils, such as aromatics and olefines, the process also includes extracting the resultant extract with dulite aqueous acids to recover the nitrogen bases from the first extract. The nitrogen bases are then recovered from the aqueous solution by adding an inorganic base to precipitate the nitrogen bases.

U.S. Pat. No. 2,035,012 to Stratford et al discloses a process for improving the color and viscosity of petroleum oils. In the process an oil is extracted with a selective solvent in combination with an acid. The selective solvent can be phenol, nitrobenzene, furfural or liquid sulfur dioxide. The acid is preferably an inorganic acid but can also be an organic acid such as picric, acetic, oxalic, citric and benzene sulfuric acids.

U.S. Pat. No. 2,541,458 to Berg discloses a process for recovery of nitrogen bases from hydrocarbon fractions. In the process the fraction is extracted with a volatile acid or nonvolatile acid salt in combination with a mutual solvent for the acid and the hydrocarbon fraction. The mutual solvents include low boiling alcohols and ketones. The extraction is conducted in the presence of water to avoid loss of the volatile acids.

U.S. Pat. No. 2,309,324 to McAllister et al discloses a method for removing nitrogen bases from water-insoluble organic solvents, mineral oils and hydrocarbon fractions. In the process the mineral oil is extracted with an aqueous, weak acid solution. The weak acids are classified as acids having dissociation constants below $10^{-3}$. The aqueous acid solutions are prepared by dissolving from 15 to 90 weight percent of an acid in water. Upon extraction of the oil, two phases are formed. The aqueous phase contains the acid and absorbed nitrogen bases. The other phase consists of the organic substance from which at least a portion of the nitrogen bases has been removed.

Many of the processes described in the above patents do not address themselves to the removal of nonbasic nitrogen compounds which can be present in organic fluids. Additionally, many of the above described processes are not specific for treatment of shale oil and the relatively high nitrogen content found in shale oil. Still further, none of the above processes are specific for lowering the nitrogen content for shale oil produced by in situ retorting of oil shale.

SUMMARY OF THE INVENTION

The present invention is directed to a method for the refining of shale oil wherein the nitrogen content of the shale oil is reduced by a process comprising lowering the viscosity of the shale oil and then contacting the shale oil with an organic acid which is selective to the nitrogen-containing compounds therein. Preferred organic acids can be formic acid, acetic acid and trichloroacetic acid. Although not essential to the operability of the nitrogen compound extraction process of the present invention, it is preferred that the organic acid be concentrated, i.e., water is present in less than fifty percent by volume. In the most preferred embodiment the water is present only to provide for two-phase formation. The viscosity of the shale oil can be reduced by a number of methods including heating and by mixing with one or more solvents or combinations of heating and solvents.

Shale oil produced by the retorting of oil shale is a liquid product which predominantly contains liquid hydrocarbons and some substituted liquid hydrocarbons such as nitrogen substituted hydrocarbons. After the viscosity of the shale oil has been reduced, a solvent which selectively substantially dissolves the nitrogen-containing compounds present in shale oil is added to the shale oil in an amount sufficient to dissolve such nitrogen-containing compounds. The amount of selective solvent system that is sufficient depends upon the solubility of such nitrogen-containing compounds in the solvent and amount of such nitrogen-containing compounds in the shale oil. The selective solvent system can also dissolve or otherwise retain some of the non-nitrogen-containing compounds present in shale oil. For this reason, during an extraction of the shale oil with a selective solvent some desirable compounds can be lost in the extractant. Therefore, the amount of selective solvent system used is also determined by balancing nitrogen extraction capabilities of the selective solvent against the amount of non-nitrogen-containing compounds also extracted. Selective solvents which are useful in extracting the nitrogen-containing compounds comprise an organic acid, preferably an organic acid selected from the group consisting of formic acid, acetic acid and trichloroacetic acid and mixtures thereof. Layer separation provides a separation of nitrogen-containing compounds from shale oil.

DETAILED DESCRIPTION OF THE INVENTION

This invention relates to the refining of shale oil and, more particularly, to the reducing of nitrogen content of shale oil.

As used herein, the term "crude shale oil" refers to the liquid product that is recovered from retorting of oil shale. The term encompasses liquid products formed during the retorting of oil shale either through aboveground retorting processes or in situ oil shale retorting processes which products have not undergone any further processing other than water removal or emulsion breaking. The term "processed shale oil" is used herein to indicate a crude shale oil which has undergone some processing, such as, for example, sulfur removal, fractionation, and the like. As used herein, the term "refined shale oil" refers to a crude shale oil or a processed shale oil which has been processed through the method of this invention to reduce the nitrogen content of such shale oil. The "refined shale oil", therefore, has a lower nitrogen content than the crude shale oil or processed shale oil undergoing the method herein disclosed.

In a preferred practice of this method, the method is utilized for refining shale oil produced from in situ retorting of oil shale. As in situ oil shale retort can be formed by many methods, such as the methods disclosed in U.S. Pat. Nos. 3,661,423; 4,043,595; 4,043,596; 4,043,597; and 4,043,598, all of which are incorporated herein by this reference.

In preparing an in situ oil shale retort, formation from within the boundaries of a retort site is excavated to form at least one void, leaving a remaining portion of unfragmented formation within the boundaries of the retort being formed. The remaining portion of unfragmented formation is explosively expanded toward such a void to form a fragmented permeable mass of formation particles containing oil shale within the retort boundaries.

After the fragmented mass is formed, the final preparation steps for producing liquid and gaseous products are carried out. These steps include drilling a plurality of feed gas inlet passages downwardly to the fragmented mass so that an oxygen-supplying gas can be supplied to the fragmented mass during retorting operations. Alternatively, the upper ends of blasting holes used in forming the fragmented mass can be cleaned and used for introducing gas to the retort. The fragmented mass connects to a product removal drift at the lower end of the fragmented mass.

During retorting operations, formation particles at the top of the fragmented mass are ignited to establish a combustion zone. An oxygen-supplying gas, such as air, is introduced to the combustion zone through the inlet passages. The oxygen-supplying gas introduced to the fragmented mass maintains the combustion zone and advances it downwardly through the fragmented mass. Combustion gas produced in the combustion zone passes through the fragmented mass to establish a retorting zone on the advancing side of the combustion zone wherein kerogen in the fragmented mass is converted to liquid and gaseous products. A sump in a portion of a drift connected to the lower end of the fragmented mass collects liquid products produced during operation of the retort. Off gas is also withdrawn through such drift to above ground.

Although the process disclosed herein of reducing the nitrogen content of shale oil is primarily discussed in relation to shale oil produced from the in situ retorting of oil shale, the process can be practiced on shale oil produced by other methods of retorting. Many of these methods for shale oil production are described in *Synthetic Fuels Data Handbook,* compiled by Dr. Thomas A. Hendrickson, and published by Cameron Engineers, Inc., Denver, Colo. For example, other processes for retorting oil shale include those known as the TOSCO, Paraho Direct, Paraho Indirect, N-T-U, and Bureau of Mines, Rock Springs, processes.

The TOSCO retorting process is described on pages 75 and 76 of the *Synthetic Fuels Data Handbook* and the U.S. Patents mentioned therein, including U.S. Pat. No. 3,025,223. Generally speaking, this process involves preheating minus ½ inch oil shale to about 500° F. in a fluidized bed. Pyrolysis is completed in a rotating drum heated by ceramic balls which are separately heated in a ball-heating furnace.

The Paraho process is described at pages 62, 63, 84 and 85 of the *Synthetic Fuels Data Handbook* and the U.S. Patents referred to therein. The Paraho process employs a vertical kiln through which ground oil shale moves downwardly as gas moves upwardly. Combustion air can be admitted into the bed of oil shale particles for direct heating of oil shale by combustion within the bed. This process is referred to as Paraho Direct. The kiln can also be arranged so that recycled gas can be heated externally, then injected into the bed of shale for indirect heating of the oil shale. Such a process is referred to as Paraho Indirect.

The N-T-U process is a batch process as described at page 59 of the *Synthetic Fuels Data Handbook* and the U.S. patents referred to therein. In the N-T-U process, a retort is filled with a batch of oil shale particles and ignited at the top. Combustion is supported by air injection and a combustion zone is passed downwardly through the stationary bed of shale. Recycled gas from the bottom of the retort is mixed with the combustion gas to modulate temperatures and provide some of the fuel requirement.

The Bureau of Mines, Rock Springs process is described in the *Synthetic Fuels Data Handbook* and also in Paper No. SPE-6067 prepared for the 51st Annual Technical Conference and Exhibition of the Society of Petroleum Engineers of AIME, held in New Orleans, Oct. 3–6, 1976, by R. L. Wise, et al. Such a process is also described in U.S. Pat. No. 3,346,044, among others. Generally speaking, this process involves fracturing of an underground oil shale formation with the fractures propped open with sand. Injection and production wells are drilled into the formation. A combustion zone is moved from an injection well towards one or more production wells for retorting oil shale in the fractured formation.

Nitrogen is removed from shale oil in the method herein by first reducing the viscosity of the shale oil and then mixing it with a solvent system which is selective to nitrogen-containing compounds present in the shale oil. Upon mixing the selective solvent system with the shale oil, nitrogen-containing compounds are extracted from the shale oil and are dissolved in or absorbed by the selective solvent. Selective solvents which are useful in extracting nitrogen-containing compounds from shale oil comprise an organic acid, preferably an organic acid selected from the group consisting of formic acid, acetic acid, trichloroacetic acid and mixtures thereof.

The process of the present invention comprises an equilibrium extraction between two phases, i.e., a polar solution and a non-polar organic solution. The desired effect is the maximum extraction of nitrogen-containing compounds into the polar phase, with a corresponding minimum extraction of non-nitrogen containing compounds into that phase. Removal of nitrogen compounds from shale oil with a concentrated organic acid is taught in copending application, Ser. No. 052638, filed June 27, 1979 in the name of Leslie E. Compton, the disclosure of which is incorporated herein by this referenced.

Shale oil, especially shale oil produced in an in situ retort is relatively viscous and has a low disengagement rate from organic acid solutions of the type taught in said application. The present invention overcomes these problems with a two-step process incorporating a viscosity reduction step prior to nitrogen compound extraction.

Reducing the viscosity of the shale oil prior to mixing with the selective solvent system can be accomplished by several methods; for example, the shale oil can be mixed with a miscible non-polar diluent for shale oil. A miscible diluent has the added benefit of back-extracting any non-polar non-nitrogen-containing compounds into the organic phase and thereby increasing recovery of low nitrogen oil and improving the efficiency of the extraction system. The miscible diluent may be chosen on the basis of relative volatility to shale oil so that it may be easily separated from the shale oil, thereby effecting complete recovery and reuse thereof. It is preferred that the miscible diluent have a higher volatility than the shale oil. Similarly, the miscible diluent may be chosen so as not to contaminate the shale oil and/or any subsequent processing thereof; it may, for example, be a hydrocarbon.

Examples of suitable volatile miscible diluents for purposes of the present invention are ethers and halocarbons such as chloroform, carbon tetrachloride and freons; examples of suitable non-contaminating miscible diluents include low molecular weight alkanes such as butane, pentane and heptane, petroleum ethers, and aromatic hydrocarbons such as benzene and toluene. The amount of miscible diluent used is dependent upon the viscosity of the shale oil being treated, the overall affect on viscosity of a particular miscible diluent, and the relative economics of the dilution step.

Another method of reducing the viscosity of the shale oil prior to mixing it with the selective solvent is to heat the shale oil. Noticeable improvements have been effected when the shale oil is heated to at least 50° C., preferred temperatures are in the range of from about 50° C. to about 60° C.

Preferably, the organic acid is concentrated, i.e., contains less than about fifty percent water by weight. The water is added to make the solvent system immiscible with the shale oil. Generally, the preferred acids, formic acid, acetic acid and trichloroacetic acid are miscible with shale oil. Preferably, the selective solvent system is at least one percent by weight water to bring about immiscibility. The phase differentiation provided by this amount of water is sufficient for effectively separating the selective solvent containing the nitrogen-containing compounds from the shale oil. The amount of water is also sufficient to prevent any appreciable dissolving of the shale oil in the selective solvent. This amount of water is also sufficient to prevent any appreciable loss of the acid portion of the selective solvent by being dissolved in the shale oil.

Extraction of the shale oil with the selective solvent can be performed in batch or continuous extraction processes using continuous or countercurrent extraction techniques. In liquid phase batch extraction there can be employed a series of multi-stage batch extractions to improve overall efficiency of the extraction and to optimize nitrogen-containing compound removal. Similarly, countercurrent extraction can also be conducted utilizing countercurrent extractors arranged in series to optimize the nitrogen-containing compound removal.

The amount of selective solvent system that is required for extracting nitrogen-containing compounds from shale oil depends upon the nitrogen content in the shale oil and the solubility of such nitrogen-containing compounds in the selective solvent. The ratio of shale oil to selective solvent system can be from about 0.20 to about ten parts by weight shale oil to one part by weight selective solvent. Generally, a significant excess of the selective solvent is utilized to insure removal of a major portion of the shale oil nitrogen.

Along with nitrogen removal from the shale oil through extraction with the selective solvent, there is some inherent loss of shale oil by the extraction procedure. For example, some of the shale oil is carried away in the extract following the separation. The most efficient separation process is a process which removes the greatest amount of nitrogen-containing compounds with little accompanying shale oil loss. Separation efficiency can be determined by measuring the nitrogen concentration in the extracted oil. The higher the nitrogen concentration in the extracted oil the more efficient is the process. Every time a nitrogen atom is removed from shale oil by the extraction process, the organic molecule on which that nitrogen is bonded must go with it. The maximum efficiency of the process is thereby limited by the molecular weight distribution of the nitrogen-bearing compounds in the shale oil and can be approached by preventing non-nitrogen compounds from dissolving in the selective solvent and by preferentially extracting smaller nitrogen molecules.

The extraction process is conducted by combining the selective solvent extractant with either a crude or a processed shale oil whose viscosity has been lowered by dilution or heating. The selective solvent system and shale oil are thoroughly intermixed to provide for rapid achievement of equilibrium. Such intermixing can be conducted, for example, by agitation in the batchwise and countercurrent extraction techniques or by the current flow in the continuous extraction techniques.

Following the contact phase of the extraction process the selective solvent extractant is separated from the shale oil. The separation is possible due to the immiscibility of the selective solvent system in shale oil. The immiscibility of the selective solvent in shale oil provides liquid-liquid phase formation whereupon one phase comprises substantially nitrogen-free shale oil and the other phase comprises substantially selective solvent and nitrogen-containing compounds. The two phases are separated by decanting, withdrawing the lower phase or by other conventional liquid-liquid separation techniques. To facilitate complete separation of the two phases of the mixture, an emulsion breaker can be added to the mixture.

The nitrogen content of shale oil can be lowered by conducting successive extractions of the diluted shale oil with selective solvent. Successive extractions can be conducted in the batchwise operation by separating the shale oil raffinate from the selective solvent pregnant with nitrogen-containing compounds after an initial extraction. The shale oil raffinate can then be extracted with fresh selective solvent system. Such successive extractions can be continued until the nitrogen content in the raffinate shale oil has been lowered to the desired level. Successive extractions can be conducted in countercurrent operation by transferring the shale oil raffinate effluent from one countercurrent extraction column into a second countercurrent extraction column against a flow of fresh selective solvent system.

After the pregnant selective solvent phase is separated from the shale oil raffinate having a reduced nitrogen content, the selective solvent can be recovered. The selective solvent is recovered by separating the nitrogen-containing compounds from the selective solvent. For example, some of the nitrogen-containing compounds that are basic can be precipitated from the selective solvent by adding a stronger base or the nitrogen-containing compounds can be extracted from the selective solvent system in another extraction process. In another method the selective solvent can be volatilized and recovered to separate it from the nitrogen-containing compounds. The selective solvent so recovered can be recycled for use in subsequent extracting steps to reduce the nitrogen content of the other shale oils.

The extracted oil can also be useful bacause of its high nitrogen content. For example, the extracted oil can be used in the production of nitrogen compounds and various chemical intermediates containing nitrogen. When the selective solvent is volatilized, the residue can be used as an asphalt which provides good adhesive properties because of its nitrogen content and capabilities to crosslink through such nitrogen present.

The following examples illustrate the method herein described for reducing the nitrogen content of shale oil.

EXAMPLES 1-4

The following examples 1-4 demonstrate the effect of temperature on the extraction process. By increasing the temperature of the extraction process, the shale oil became less viscous. The less viscous shale oil provided faster achievement of equilibrium, better phase disengagement and separation than extractions conducted at lower temperatures.

There were no significant changes in the amount of nitrogen extracted or in percentage shale oil recovered over similar extractions performed at lower temperatures.

The results of extractions conducted with acetic acid and formic acid in a temperature of 50° C. to 60° C. are listed in Table I.

Table II shows a comparison of high temperature extraction versus room temperature extractions. Table II shows a comparison of Examples 1-4 which were for extractions conducted under respectively identical conditions except that the temperature was room temperature.

TABLE I

| Example No. | Stage | Component Ratios Oil:$H_2O$:Acid | Component Ratios Oil:Solvent | Nitrogen in Raffinate Wt. % | Nitrogen Removed Wt. % | Oil Recovered in Raffinate, Wt. % Each Stage | Oil Recovered in Raffinate, Wt. % Cum. | Nitrogen in Extracted Oil Wt. % | Oil Dissolved in Solvent Phase Wt. % of Solution |
|---|---|---|---|---|---|---|---|---|---|
| HIGH TEMPERATURE ORGANIC ACID EXTRACTIONS | | | | | | | | | |
| | | | | | Acetic Acid | | | | |
| 1 | 1 | 8.6:1:7.9 | 1:1.0 | 0.437 | 66.38 | 75.11 | — | 2.31 | 21.91 |
| | 2 | 9.8:1:9.6 | 1:1.1 | 0.272 | 79.08 | 87.86 | 65.99 | 0.50 | 11.06 |
| | 3 | 8.0:1:9.4 | 1:1.3 | 0.217 | 83.31 | 91.23 | 60.20 | 0.19 | 7.60 |
| 2 | 1 | 6.4:1:8.7 | 1:1.5 | 0.352 | 72.92 | 72.27 | — | 2.39 | 18.19 |
| | 2 | 6.5:1:9.2 | 1:1.6 | 0.223 | 82.85 | 87.03 | 62.90 | 0.32 | 8.01 |
| | 3 | 5.5:1:9.3 | 1:1.9 | 0.161 | 87.62 | 88.18 | 55.47 | 1.31 | 7.07 |
| | | | | | Formic Acid | | | | |
| 3 | 1 | 33.3:1:5.0 | 5.6:1 | 0.460 | 64.62 | 78.87 | — | 3.51 | 57.62 |
| | 2 | 32.8:1:4.7 | 5.7:1 | 0.307 | 76.38 | 95.01 | 74.93 | 2.64 | 24.31 |
| | 3 | 29.0:1:4.6 | 5.2:1 | 0.307 | 76.38 | 98.78 | 74.02 | 3.42 | 5.02 |
| 4 | 1 | 9.2:1:2.1 | 3.0:1 | 0.693 | 46.69 | 86.60 | — | 4.59 | 31.55 |
| | 2 | 7.9:1:2.2 | 2.5:1 | 0.417 | 67.92 | 93.00 | 80.54 | 2.68 | 15.52 |
| | 3 | 8.7:1:2.2 | 2.8:1 | 0.380 | 70.77 | 98.17 | 79.06 | 3.10 | 5.09 |

TABLE II

HIGH TEMPERATURE EXTRACTIONS vs ROOM TEMPERATURE EXTRACTIONS

| Example No. | Stage | Oil:Solvent | Nitrogen Removed Wt. % | Oil Recovered in Raffinate, Wt. % Each Stage | Oil Recovered in Raffinate, Wt. % Cumulative |
|---|---|---|---|---|---|
| 5 | 90% Acetic Acid at 50° | | | | |
| | 1 | 1:1.0 | 66.38 | 75.11 | — |
| | 2 | 1:1.1 | 79.08 | 87.86 | 65.99 |
| | 3 | 1:1.3 | 83.31 | 91.23 | 60.20 |
| | 90% Acetic Acid at Room Temperature | | | | |
| | 1 | 1:1.1 | 61.23 | 77.82 | — |
| | 2 | 1:1.4 | 75.00 | 81.58 | 63.48 |
| | 3 | 1:1.4 | 79.23 | 95.84 | 60.84 |
| 6 | 90% Acetic at 50°-60° | | | | |
| | 1 | 1:1.5 | 72.92 | 72.27 | — |
| | 2 | 1:1.6 | 82.85 | 87.03 | 62.90 |
| | 3 | 1:1.9 | 87.62 | 88.18 | 55.47 |
| | 90% Acetic at Room Temperature | | | | |
| | 1 | 1:1.2 | 64.00 | 79.47 | — |
| | 2 | 1:1.3 | 69.15 | 85.36 | 67.83 |
| | 3 | 1:1.4 | 73.38 | 88.72 | 60.18 |
| 7 | 80% Formic Acid at 50°-60° C. | | | | |
| | 1 | 5.6:1 | 64.62 | 78.87 | — |
| | 2 | 5.7:1 | 76.38 | 95.01 | 74.93 |
| | 3 | 5.2:1 | 76.38 | 98.78 | 74.02 |
| 8 | 80% Formic Acid at Room Temperature | | | | |
| | 1 | 7.6:1 | 20.77 | 97.34 | — |
| | 2 | 5.0:1 | 43.15 | 96.10 | 93.55 |
| | 3 | 4.1:1 | 46.92 | 94.72 | 88.61 |
| | 68% Formic Acid at 50°-60° | | | | |
| | 1 | 3.0:1 | 46.69 | 86.60 | — |
| | 2 | 2.5:1 | 67.92 | 93.00 | 80.54 |
| | 3 | 2.8:1 | 70.77 | 98.17 | 79.06 |
| | 72% Formic Acid at Room Temperature | | | | |
| | 1 | 2.4:1 | 45.46 | 89.30 | — |
| | 2 | 1.5:1 | 69.00 | 91.30 | 81.53 |
| | 3 | 2.1:1 | 70.69 | 82.20 | 67.02 |

What is claimed is:

1. A method for reducing the nitrogen content of shale oil by removing nitrogen-containing compounds from shale oil, comprising the steps of:

(a) reducing the viscosity of the shale oil by mixing the shale oil with a miscible non-polar diluent selected from the group consisting of ethers, chloroform, carbon tetrachloride and halocarbons;

(b) extracting nitrogen-containing compounds from the shale oil with a selective solvent system for the nitrogen-containing compounds consisting essentially of from about one to about fifty percent by weight water and an organic acid selected from the group consisting of formic acid, acetic acid, trichloracetic acid and mixtures thereof; and, (c) separating the solvent phase containing nitrogen-containing compounds from the shale oil phase having a reduced nitrogen content.

2. A method as recited in claim 1 wherein the ratio of shale oil to selective solvent system comprises from about 0.20 to about 10 parts by weight shale oil to one part by weight selective solvent.

3. A method for reducing the nitrogen content of shale oil by removing nitrogen-containing compounds consisting essentially of the steps of:

(a) reducing the viscosity of the shale oil by heating the shale oil into the range of from about 50° C. to about 60° C.;

(b) extracting the shale oil at least once with a selective solvent system for nitrogen-containing compounds consisting essentially of from about one to about fifty percent by weight water and an organic acid selected from the group consisting of formic acid, acetic acid, trichloracetic acid and mixtures thereof;

(c) separating the solvent phase containing the nitrogen-containing compounds from the shale oil phase having a reduced nitrogen content; and (d) recovering the selective solvent by removing the organic acid selective solvent from the nitrogen-containing compounds.

4. A method as recited in claim 3 wherein the recovered selective solvent is recycled for extracting nitrogen-containing compounds from shale oil containing nitrogen-containing compounds.

5. A method as recited in claim 3 wherein the extraction is conducted batchwise in at least three successive batch extractions.

6. A method as recited in claim 3 wherein the extraction is conducted by a continuous countercurrent extraction.

7. A method as recited in claim 6 wherein the recovered selective solvent is recycled for the continuous countercurrent extraction.

8. A method for reducing the nitrogen content of shale oil by removing nitrogen-containing compounds comprising the steps of:

(a) mixing the shale oil with a diluent to lower the viscosity of the shale oil;

(b) extracting the shale oil at least once with a selective solvent for nitrogen-containing compounds consisting essentially of from about one to about ten percent by weight water and an organic acid selected from the group consisting of acetic acid, trichloracetic acid, and mixtures thereof;

(c) separating the solvent phase containing the nitrogen-containing compounds from the shale oil phase having a reduced nitrogen content; and, (d) recovering the selective solvent by removing the organic acid selective solvent from the nitrogen-containing compounds.

9. A method as recited in claim 8 wherein the recovered selective solvent is recycled for extracting nitrogen-containing compounds from shale oil containing nitrogen-containing compounds.

10. A method as recited in claim 8 wherein the extraction is conducted batchwise in at least three successive batch extractions.

11. A method as recited in claim 8 wherein the extraction is conducted by a continuous countercurrent extraction.

12. A method as recited in claim 8 wherein the recovered selective solvent is recycled for the continuous countercurrent extraction.

* * * * *